US005918330A

United States Patent [19]

Navarro et al.

[11] Patent Number: 5,918,330

[45] Date of Patent: Jul. 6, 1999

[54] RATCHET MECHANISM FOR BOOTED SURGICAL STIRRUP

[75] Inventors: Richard Navarro, Strongsville; Yury Keselman, Beachwood, both of Ohio

[73] Assignee: Allen Medical Systems, Inc., Garfield Heights, Ohio

[21] Appl. No.: 08/910,425

[22] Filed: Aug. 13, 1997

Related U.S. Application Data

[60] Provisional application No. 60/023,408, Aug. 14, 1996.

[51] Int. Cl.[6] ..... A61G 7/075

[52] U.S. Cl. ..... 5/624; 5/651

[58] Field of Search ..... 5/602, 624, 648, 5/649, 650, 651; 128/882

[56] References Cited

U.S. PATENT DOCUMENTS

| | | | |
|---|---|---|---|
| 612,373 | 10/1898 | Allison . | |
| 891,678 | 6/1908 | Downey . | |
| 891,679 | 6/1908 | Downey . | |
| 1,823,248 | 9/1931 | Allison . | |
| 2,465,781 | 3/1949 | Banta . | |
| 2,679,445 | 5/1954 | Roehm . | |
| 4,426,071 | 1/1984 | Klevstad | 5/624 |
| 4,526,355 | 7/1985 | Moore et al. . | |
| 4,564,164 | 1/1986 | Allen et al. . | |
| 4,615,516 | 10/1986 | Stulberg et al. . | |
| 4,913,413 | 4/1990 | Raab . | |
| 4,940,218 | 7/1990 | Akcelrod | 5/624 |
| 5,116,008 | 5/1992 | Allen . | |
| 5,135,210 | 8/1992 | Michelson . | |
| 5,157,800 | 10/1992 | Borders . | |
| 5,369,827 | 12/1994 | Parke et al. | 5/649 |
| 5,560,577 | 10/1996 | Keselman . | |
| 5,582,379 | 12/1996 | Keselman et al. | 5/624 |

*Primary Examiner*—Michael F. Trettel

*Attorney, Agent, or Firm*—Pearne, Gordon, McCoy & Granger LLP

[57] ABSTRACT

An improved ratchet mechanism for a surgical boot is not susceptible to spontaneous rotation when the center of gravity of the weight of the patient's leg, the boot, and the support arm for the boot passes the axis of rotation of the ratchet mechanism. The ratchet mechanism includes a ratchet wheel which includes both ratcheting serrations which allow rotation of the support arm in only one direction and locking serrations which do not allow the support arm to rotate in either direction. A ratchet release allows such constraints on rotation to be removed by the surgeon or surgeon's assistant.

16 Claims, 5 Drawing Sheets

RATCHET MECHANISM FOR BOOTED SURGICAL STIRRUP

CROSS-REFERENCE TO RELATED APPLICATION

This application claims the benefit of U.S. Provisional Application No. 60/023,408, filed Aug. 14, 1996.

BACKGROUND OF THE INVENTION

The present invention generally relates to booted stirrups for holding a person's leg during surgery, and more specifically, to a ratchet mechanism for a booted stirrup.

Surgical stirrups typically include a boot which holds a foot of a person during surgery to orient and/or position the person's leg. The stirrups also typically include a support arm attached to the operating room table which supports the boot. The support arm of some stirrups rotate by means of a ratchet mechanism to different fixed angular positions. For example, see U.S. Pat. No. 5,560,577 and U.S. patent application Ser. No. 08/412,148, now U.S. Pat. No. 5,582,379, the disclosures of which are expressly incorporated herein in their entireties by reference. These stirrups may have the disadvantage that when the support arm is upwardly rotated to a point in which the center of gravity of the combination of the leg, the boot, and the support arm is past the axis of rotation of the ratchet mechanism, the support arm spontaneously continues to rotate due to gravity. Accordingly, there is a need in the art for an improved ratchet mechanism for a surgical stirrup which is not susceptible to spontaneous rotation due to gravity.

SUMMARY OF THE INVENTION

The present invention provides an improved ratchet mechanism for a surgical stirrup which overcomes at least some of the above-noted problems. The ratchet mechanism includes a ratchet wheel which includes both ratcheting serrations which allow rotation of the support arm in only one direction and locking serrations which do not allow the support arm to rotate in either direction.

BRIEF DESCRIPTION OF THE DRAWINGS

The present invention will hereafter be described with reference to the drawing figures, wherein.

DETAILED DESCRIPTION OF PREFERRED EMBODIMENTS

Figure 1:
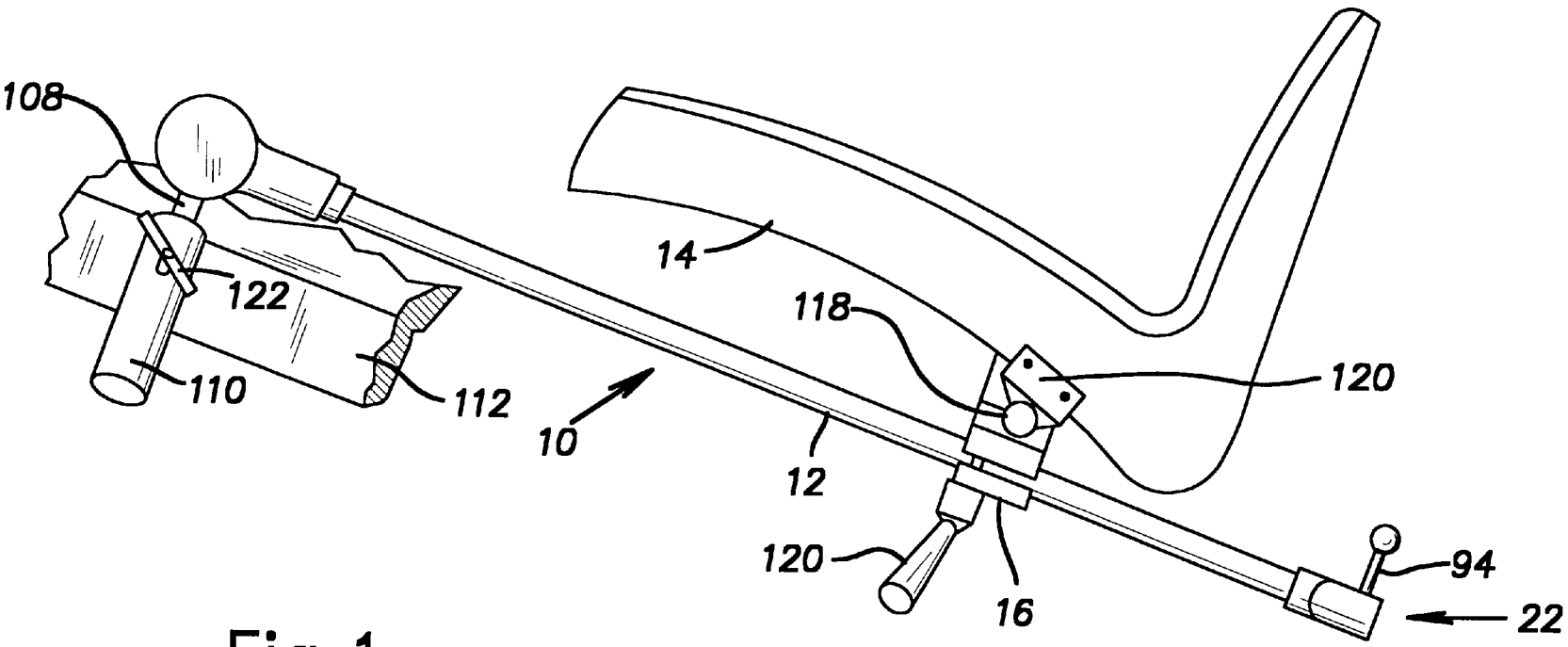
FIG. 1 is a perspective view of a booted surgical stirrup according to the present invention.
Figure 2:
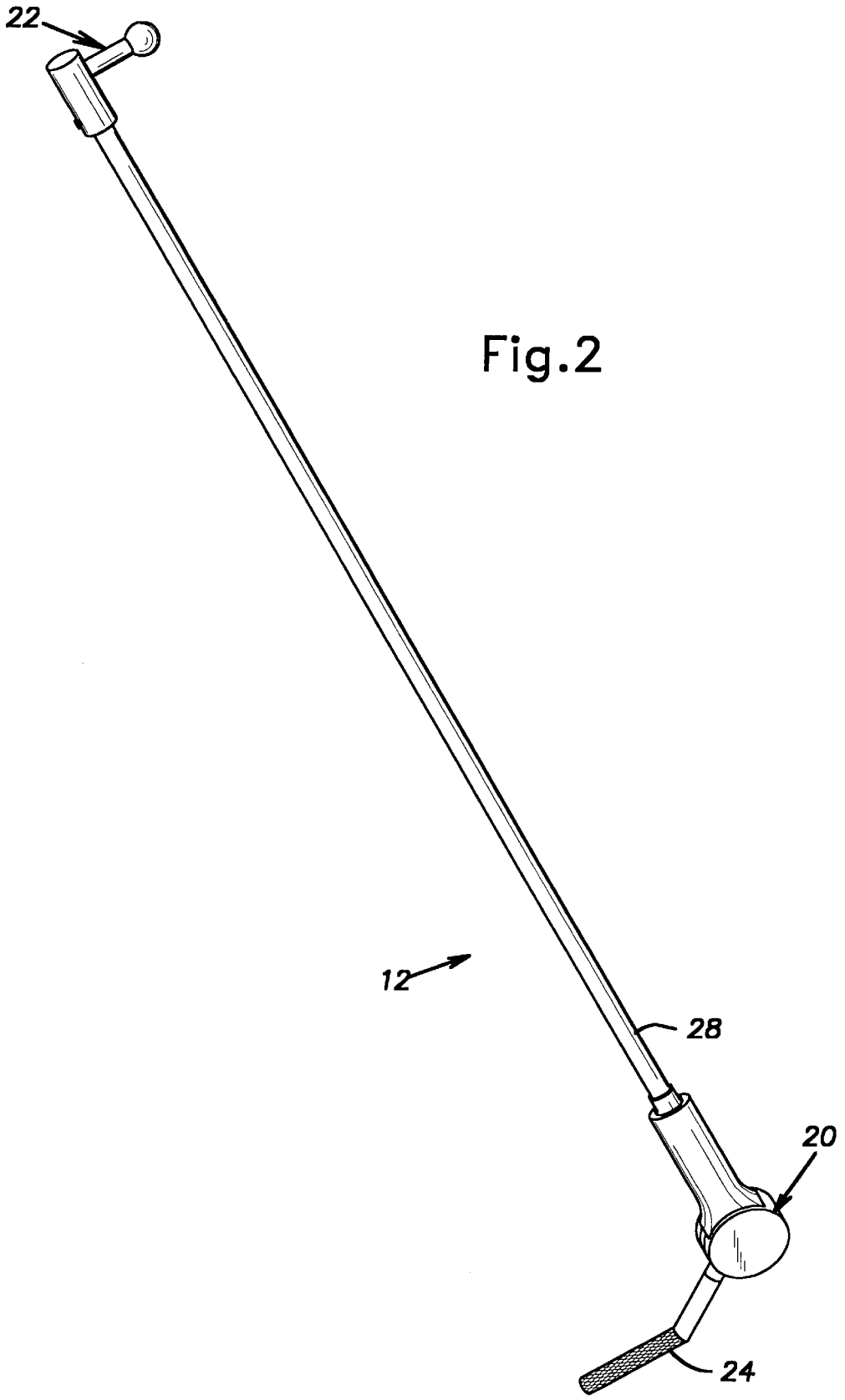
FIG. 2 is an enlarged perspective view of a support arm assembly of the stirrup of FIG. 1.
Figure 3:
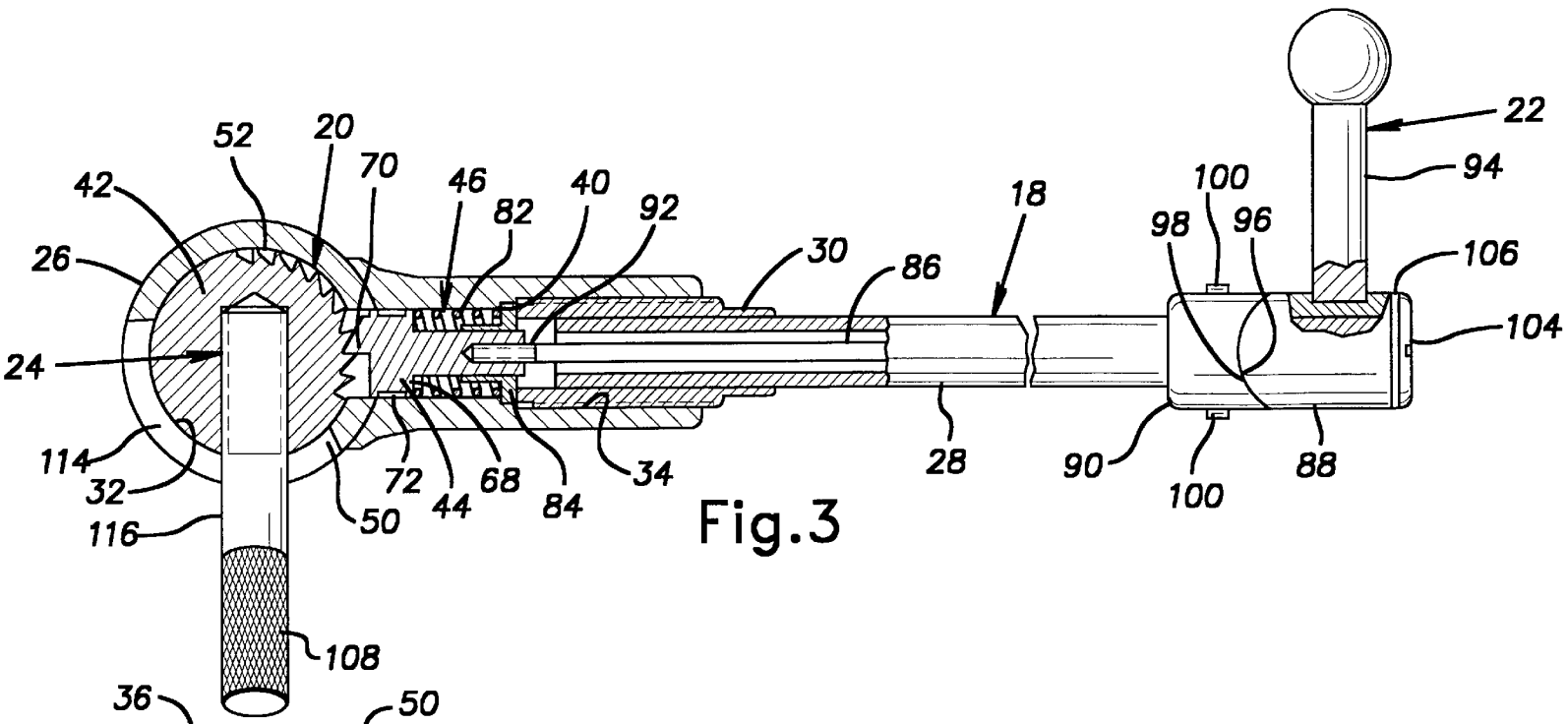
FIG. 3 is an enlarged elevational view, partially in cross section, of the support arm assembly of FIG. 2.
Figure 4:
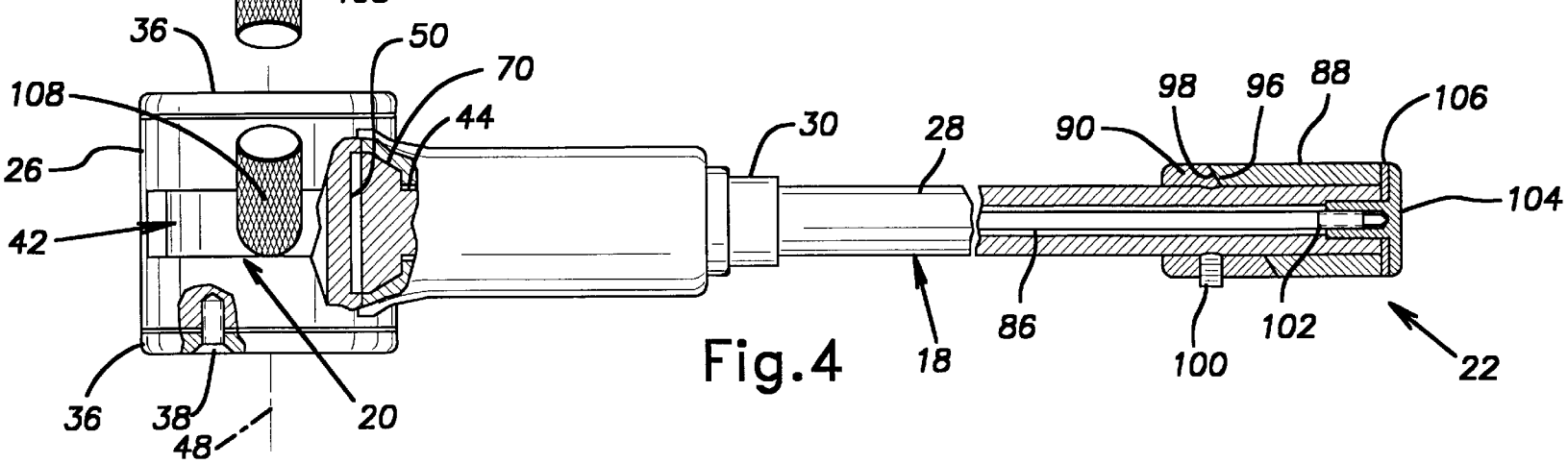
FIG. 4 is an enlarged plan view, partially in cross section, of the support arm assembly of FIG. 2.

FIG. 1 illustrates a booted surgical stirrup 10 according to the present invention. The stirrup 10 includes a support arm assembly 12, a floating or swinging boot 14, and an three-axis adjustable support 16 which connects the boot 14 to the support arm assembly 12. As best shown in FIGS. 2–4, the support arm assembly 12 includes a support arm 18, a ratchet mechanism 20, a ratchet mechanism release 22, and an attachment 24.

The support arm 18 includes a housing 26, a tube 28, and a connecting member 30. The housing 26 has first and second cylindrically-shaped cavities 32, 34 which are perpendicular to one another. The first cavity 32 laterally extends and is open at each end. The two open ends of the first cavity 32 are covered by end caps 36 which are each attached by threaded fasteners 38 such as, for example flat head screws. The second cavity 34 longitudinally extends and is open at one end and opens into the first cavity 32 at the other end. The second cavity 34 has an outer portion, towards the open end, with an inner diameter larger than an inner diameter of an inner portion to form a step 40 therebetween. The outer portion of the second cavity 32 is internally threaded.

The tube 28 is circular in cross-section and contained at one end within the connecting member 30. The connecting member 30 is tubularly shaped and has an externally threaded portion which mates with the second cavity 34 of the housing 26. The inner diameter of the connecting member 30 is sized to receive the tube 28 therein. The outer diameter of the tube 28 is sized to mate with the adjustable support 16 (as best shown in FIG. 1). It will be observed that other embodiments of the support arm 18 can be utilized such as, for example, the tube 28 could have a forked-end which sits astride the ratchet mechanism.

The ratchet mechanism 20 includes a ratchet wheel 42, a lock pin 44, and a spring assembly 46. The outer diameter of the ratchet wheel 42 is sized to fit within the first cavity 32 of the housing 26 so that the support arm 18 is rotatable about a central axis 48 of the ratchet wheel 42. The outer periphery of the ratchet wheel 42 forms a plurality of serrations 50, 52. The ratchet wheel 42 of the illustrated embodiment has ten serrations 50, 52 which position the support arm in ten fixed angular positions. The fixed positions of the illustrated embodiment are −26°, −13°, 0° (horizontal), 13 °, 26°, 39°, 52°, 65°, 78°, and 91°. It will be observed, however, that a greater or fewer number of fixed angular positions or different angular positions can be utilized.

The lower seven angular positions are provided by ratcheting serrations 50 and the upper three positions are provided by locking serrations 52. The ratcheting serrations 50 prevent the support arm 18 from rotating in one direction (clockwise as shown in FIG. 3) and allow the support arm 18 to rotate in the other direction (counterclockwise as shown in FIG. 3). The locking serrations 52 prevent the support arm 18 from rotating in either direction to prevent spontaneous rotation of the support arm 18 by gravity due to the center of gravity of the assembly rotating past the axis of rotation 48. Preferably angular positions approaching, at, and/or past vertical (90°) are provided by the locking serrations 52. In the illustrated embodiment, each angular position greater than or equal to 65° is provided by a locking serration 52.

Figure 6:
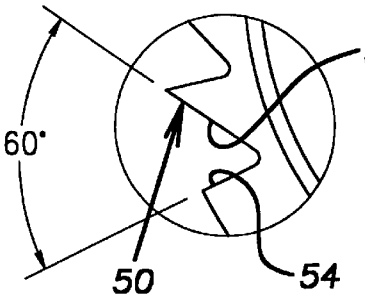
FIG. 6 is an enlarged view of a ratcheting serration of the ratchet wheel of FIG. 5.
Figure 5:
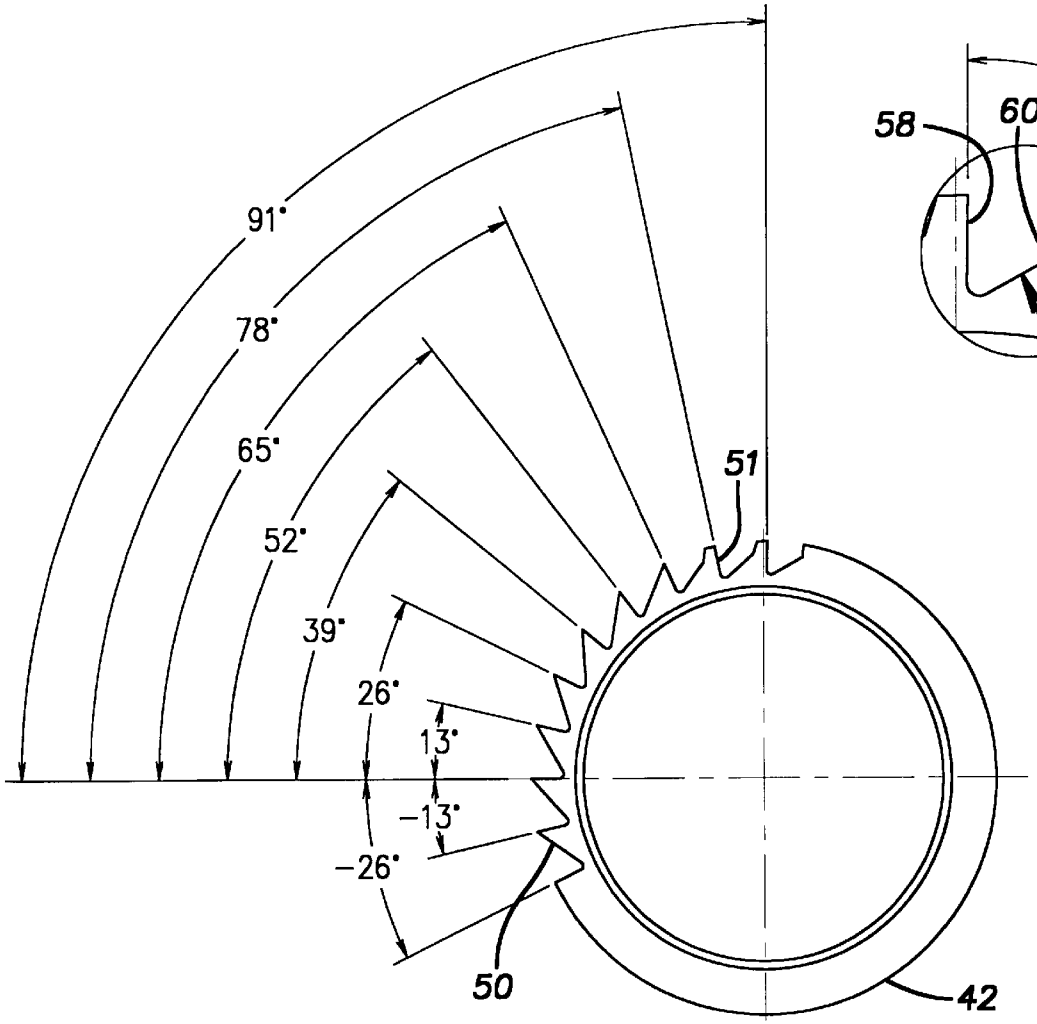
FIG. 5 is an enlarged elevational view of a ratchet wheel of the support arm assembly of FIG. 3.

As best shown in FIGS. 5 and 6, the ratcheting serrations 50 have a radially extending lower edge 54 and an upper edge 56 extending from the lower edge 54 with acute angle therebetween. The angle of the upper edge 56 is sized to outwardly cam the locking pin 44 out of the ratcheting serration 50 when the support arm is rotated in a direction toward the upper edge 56. The angle between the lower and upper edges 54, 56 is preferably about 60°.

Figure 7:
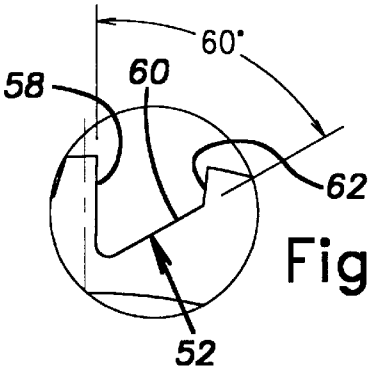
FIG. 7 is an enlarged view of a locking serration of the ratchet wheel of FIG. 5.

As best shown in FIGS. 5 and 7, the locking serrations 52 have a radially extending lower edge 58, an upper edge 60 extending from the lower edge 58, and a locking edge 62 extending from the upper edge 60. The lower edge 58 radially extends like the lower edge 54 of the ratcheting serrations 50. The upper edge 60 extends from the lower edge 58 with an angle the same as the upper edge 56 of the ratcheting serrations 50. The locking edge 62 extends from the upper edge 60 at an angle which prevents the locking pin 44 from outwardly camming from the locking serration 52 when the support arm is rotated toward the locking edge 62. The illustrated embodiment has a radially extending locking edge 62, that is, the locking edge 62 is substantially parallel to the lower edge 58.

Figure 8:
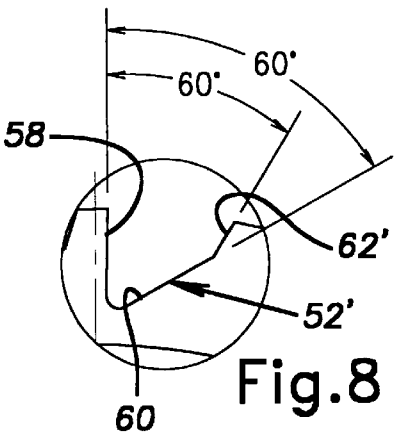
FIG. 8 is an enlarged view of a variation of the locking serration of the ratchet wheel of FIG. 5.
Figure 9:
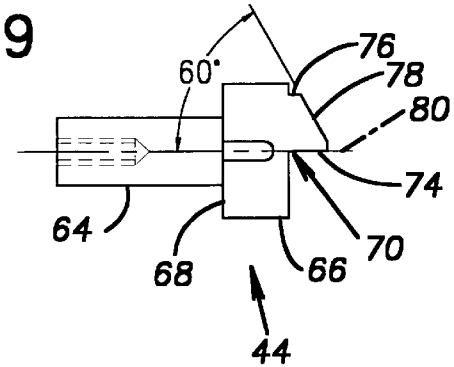
FIG. 9 is an enlarged elevational view of a locking pin of the support arm assembly of FIG. 3.

FIG. 8 illustrates a locking serration 52' which is a variation of the locking serration 52 of FIG. 7. The locking serration 52' has a locking edge 62' which is not radially extending or parallel to the lower edge 60 and is at a steeper angle to the lower edge 58 than the upper edge 60. The illustrated locking edge 62' forms a 30 degree angle with the lower edge 58. This or another angle together with the load imposed by the spring assembly 46 or by other lock-pin retractor springing means may be chosen such that the lock imposed by the interengagement between the edges As best shown in FIGS. 3 and 9, the lock pin 44 has a first cylindrically-shaped portion 64, a second cylindrically shaped portion 66 extending from the first portion 64 with an outer diameter larger than the first portion to form a step 68 therebetween, and a protrusion 70 extending from the end of the second portion 66. The second portion 66 has an outer diameter sized to extend within the second cavity 34 of the housing 26. The second portion 66 is preferably provided with a recess 72 to minimize contact with the housing 26 and thereby friction created by relative movement between the housing 26 and the lock pin 44.

The protrusion 70 is shaped to extend into the serrations 50, 52. The protrusion 70 has a first or long side 74, a second or short side 76, and an angled end 78 extending between the first and second sides 74, 76. The first side 74 is substantially parallel to a central axis 80 of the lock pin. 44 and engages the lower edges 54, 58 of the serrations 50, 52. The second side 76 is at an angle generally equal to the locking edge 62 of the locking serrations 52 and engages the locking edge 62 of the locking serrations 52. In the illustrated embodiment, the second side 76 is substantially parallel to the first side 74. The end 78 is at an angle generally equal to the upper edge 56, 60 of the serrations 50, 52 and engages the upper edge 56, 60 of the serrations 50, 52. In the illustrated embodiment the end 78 is at an angle of about 60° with the first side 74.

Figure 10:
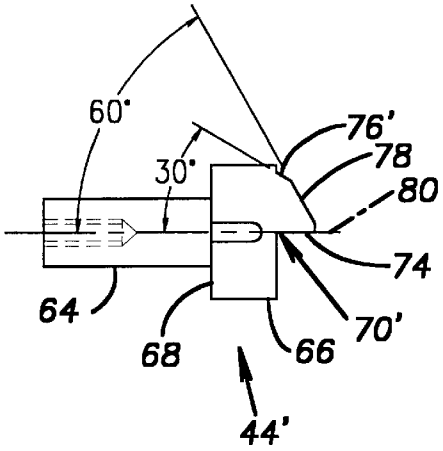
FIG. 10 is an enlarged elevational view of a variation of the locking pin of the support arm assembly of FIG. 3.

FIG. 10 illustrates a lock pin 44' which is a variation of the lock pin 44 of FIG. 9 and is modified to cooperate with the alternative locking serration 52' shown in FIG. 8. The protrusion 70' of the lock pin 44' has a second side 76' which is not radially extending or parallel to the first side 74 and is at a angle which cooperates with the locking edge 62' of the locking serration 52'. The illustrated second side 76' forms a 30 degree angle with the first side 74.

The illustrated locking edge 62' forms a 30 degree angle with the lower edge 58. The edges 62' and 76' may have other angles than 30 degrees, and the angle of these edges together with the load imposed by the spring assembly 46 or by other lock-pin retractor springing means may be chosen such that the lock imposed by the interengagement between the edges 62' and 76' may be overcome by sufficient force pushing the support arm in the advancing direction, causing the edge 76' to cam up on the edge 62' until the more shallowly angled edge 78 comes in sliding contact with the edge of the ratcheting serration and the arm can then be relatively easily advanced to the next more advanced position. (In such arrangement, the edge 62' and 76' will be understood to constitute part of a ratchet release comprising linkage means for overcoming the spring-loading of the locking pin.) This arrangement allows the surgeon or an assistant to overcome the locking action of the interengaging edges 62' and 74' without directly manipulating a lock-pin release mechanism but rather by indirectly. In this arrangement, the force required is chosen to be well in excess of that imposed by the weight of the patient limb, boot, support arm, and related elements, so that spontaneous rotation does not occur.

As best shown in FIG. 3, the lock pin 44 is urged into engagement with one of the serrations 50, 52 by the spring assembly 46. The spring assembly 46 includes a helical coil compression spring 82 and spring retainer 84. The spring 82 provides a force large enough to hold the lock pin 44 in the serration 50, 52 of the ratchet wheel 42 when supporting weight but small enough to be overcome by camming of the locking pin 44 or by the ratchet mechanism release 22. It will be noted that other types of springs 82 such as, for example, a leaf spring can be alternatively utilized.

The spring retainer 84 is tubularly-shaped with an inner diameter sized to slide over the first portion 64 of the lock pin 44, and an outer diameter sized to fit within the inner diameter of the spring 82. The spring retainer 84 also has a flange with a diameter sized to fit within the second cavity 34 of the housing 26. The flange of the spring retainer 84 is held against the step 40 in the second cavity 34 by the connecting member 30. The spring 82 is retained between the flange of the spring retainer 84 and the step 68 of the lock pin 44. With the spring retainer 84 is fixed to the housing 26, the spring 82 urges the lock pin 44 toward the ratchet wheel 42 so that the protrusion 70 engages a serration 50, 52 of the ratchet wheel 42.

As best seen in FIGS. 3 and 4, the ratchet mechanism release includes a traction rod 86, a cam 88, and a cam base 90. The traction rod 86 is an elongate rod with a diameter sized to fit within the tube 28 of the support arm 18. A first end 92 of the traction rod 86 is fixed to the lock pin 44. In the illustrated embodiment, the end 92 of the traction rod 86 is externally threaded and mates to an internally threaded hole formed in the first portion 64 of the lock pin 44. Preferably, the traction rod 86 is additionally spot welded to the lock pin 44.

The cam 88 and the cam base 90 are each tubularly-shaped having an inner diameter sized to slide over the outer diameter of the support arm tube 28. The cam 88 is provided with a handle 94 for rotating the cam 88 about the tube 28 of the support arm 18. An upper surface 96 of the cam base 90 is angled in relation to the central axis of the tube 28. A lower surface 98 of the cam 88 is angled in relation to the central axis of the tube 28 and cooperates with the upper surface 96 of the cam base 90. The cam base 90 forms three internally threaded holes which are located 90° from each other and are sized to cooperate with set screws 100. The set screws 100 prevent movement of the cam base 90 relative to the tube 28 of the support arm 18.

The cam 88 is connected to a second end 102 of the traction rod 86. In the illustrated embodiment, the traction rod 86 is connected by an end cap 104. The end cap 104 has a cylindrical portion with a diameter sized to fit within the inner diameter of the tube 28 and a flange portion with a diameter sized to retain the cam 88 on the tube 28. The cylindrical portion of the end cap 104 forms an internally threaded hole which mates with external threads on the end 102 of the traction rod 86.

The longitudinal position of the cam base 90 is adjustable to ensure that the cam 88 is closely constrained between the cam base 90 and the end cap 104. Preferably, a low friction material washer 106 is located between the cam 88 and the end cap 102 to reduce friction therebetween and thereby ease rotation of the cam 88.

As best shown in FIGS. 1–4, the attachment 24 includes a post 108 secured to the ratchet wheel 42 and a socket 110 secured to the operating room table 112 which receives the post 108. In the illustrated embodiment, the post 108 is externally threaded at one end to mate with an internally threaded hole formed in the ratchet wheel 42. It will be noted, however, that the post 108 could be secured by other methods known to those skilled in the art such as, for example, welded. The post 108 extends from the ratchet wheel 42 through an opening formed in the housing 26. It will be observed that other embodiments of the attachment 24 known to those skilled in the art can be utilized such as, for example, a clamp.

The post 108 preferably has a bend 116 with an angle in the range of about 10 degrees to about 30 degrees, so that the support arm 18 has an outwardly and downwardly angled axis of rotation 48 when attached to the side of the table 112. The angled axis of rotation 48 automatically abducts or separates the limbs of the patient as the support arm 18 is rotated about the ratchet wheel 42.

As shown in FIG. 1, the boot 14 is provided with a transversely extending connecting rod 118. The connecting rod 118 is welded, or otherwise connected, to a bracket 120 fastened to the boot 14. Preferably, the boot 10 can float or freely rotate about the axis of the connecting rod 118 when the connecting rod 118 is retained by the adjustable support 16. The adjustable support 16 connects the boot 14 to the support arm assembly 12 and allows the position and orientation of the boot 14 to be adjusted and locked with a single handle 120. See the herein-incorporated disclosure of aforementioned U.S. Pat. No. 5,560,577 for a detailed description of a suitable adjustable support 16.

Referring to FIG. 1, the stirrup 10 is shown in the zero degree or horizontal position. The post 108 is removably secured in the socket 110 and rotationally held by a clamp 122. A second stirrup (not shown) according to the invention is typically secured to the opposite side of the table 112 in the same manner. In this configuration a patient lies with their back on the table 112 with a foot in each boot 14. The orientation and position of the boots 14 are adjusted by the adjustable support 16 and the support arm assembly 12. For example, the surgeon can raise the support arm assembly 12 through the fixed angular positions with ratcheting serrations 50 by pushing upwardly on the support arm 18 of the support arm assembly 12. The support arm 18 ratchets upward and automatically locks into the next angular position.

When a higher-angle position for the support arm 18 is desired and the protrusion 70 is located in a ratcheting serration 50, an upwardly directed force is applied to the support arm 18. As the support arm 18 is pushed upward, the housing 26 and tube 28 rotate about the centerline 48 of the ratchet wheel 42. The spring 82 is compressed by the lock pin 44 as the protrusion 70 follows the angled upper edge 56 of the serration 50. Once the next serration 50, 52 is reached, the spring 82 urges the lock pin 46 into the next serration 50, 52 to lock the support arm 18 in the new angular position. The procedure is repeated if yet a higher-angle position is desired for the support arm 18 and the protrusion 70 is in a ratcheting serration 50.

When a higher-angle position for the support arm 18 is desired and the protrusion 70 is located in a locking serration 52, the ratchet mechanism release 22 must be activated to disengage the lock pin 44 from the serration 52 so that the support arm 18 can be rotated. The support arm can not be ratcheted from the locking serration 52 as described above for the ratcheting serrations 50 because the locking edge 62 does not allow the protrusion 70 to cam out of the locking serration 52. The locking serrations 52 prevent the support arm 18 from spontaneously rotating due to gravity when a center of gravity of the stirrup 10 and patients leg is moved past the axis of rotation 48. Additionally, when a lower angular position for the support arm 18 is desired, the ratchet mechanism release 22 must be activated to disengage the lock pin 44 from the serration 50, 52 so that the support arm 18 can be downwardly rotated. The support arm 18 can not be ratcheted to a lower-angular position as described above to obtain a higher-angular position because the lower edge 54, 58 of the serration 50,52 holds the support arm 18 in the fixed angular position and does not allow the protrusion 70 to cam out of the serration 50, 52.

Figure 11:
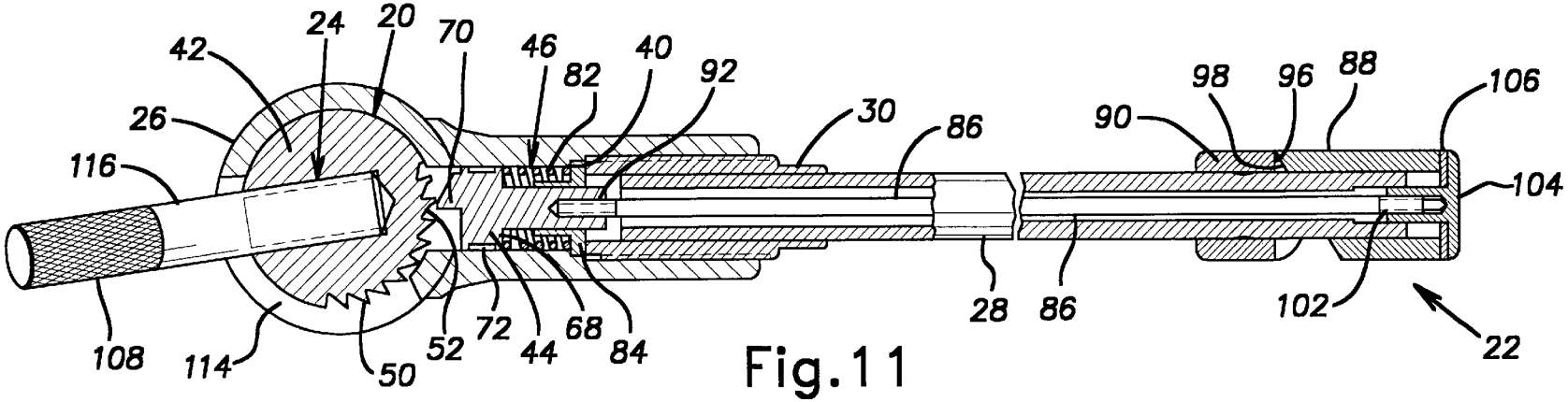
FIG. 11 is an elevational view, partially in cross section, of the support arm assembly, similar FIG. 3 but with the lock pin in a released position.

To activate the ratchet mechanism release 22, the handle 94 is turned to rotate the cam 88 about the tube 28 of the support arm 18. As the cam 88 rotates, the lower surface 98 of the cam 88 follows or rides up the upper surface 96 of the cam base 90 as shown in FIG. 11. As the cam 88 rides up the cam base 90, the end cap 104 is outwardly moved and causes the traction rod 86 to overcome the spring 82 and outwardly pull the lock pin 44 from the serration 50,52. The lock pin 44 disengages the serration 50, 52 of the ratchet wheel 42. Once the lock pin 44 is disengaged, the support arm 18 is freely rotatable about the ratchet wheel 42 to a new angular position. The handle 94 is then turned in the opposite direction to return the cam 88 back to its original position. The spring 82 urges the lock pin 44 into engagement with serration 50, 52 of the ratchet wheel 42 at the angular position.

While the above-described embodiment of the invention includes an automatic abduction feature due to the presence of the bend 116 in the post 108 so that the support arm has an outwardly and downwardly angled axis of rotation and the support arm therefore rotates upwardly and outwardly as it is advanced from one setting to the next higher setting, the invention may be embodied in an adjustable limb support system in which the corresponding post has no bend so that the system has no automatic abduction feature.

The invention has been described so far in connection with an adjustable limb support system using a post-mounted ratchet mechanism 20 which is mounted on the operation table via the post 110 and clamp 122. The invention can also be used for an adjustable limb support system using a ratcheting table clamp such as the clamp 106 seen in FIG. 7 of the herein-incorporated disclosure of aforementioned U.S. patent application Ser. No. 08/412,148. The details of the overall structure of such system may be similar or identical to those shown and described for any of the embodiments in such disclosure except that (1) the ratchet wheel of such system is modified to include locking serrations corresponding to the higher or more advanced angular positions of the system (such locking serrations being shaped similarly to the locking serration 52 shown in FIG. 7 or the modified locking serration 52' shown in FIG. 8) while continuing to employ ratcheting serrations identical to those shown in the prior disclosure but only in association with the lower or less advanced angular positions of the system, and (2) the protruding end of the lock pin is shaped to suitably engage such locking serrations as well as the ratcheting serrations, similarly or identically to the shaping of the protrusions 70 or 70' of FIGS. 9 and 10.

If the invention is embodied in an adjustable limb support system having a ratcheting table clamp as just described, the system will have an automatic abduction feature due to the outwardly and downwardly angled axis of the mounting portion 124 of attachment 112 of table clamp 106 as seen in FIGS. 7–9 of the aforementioned Ser. No. 08/412,148, such axis also being the axis about which the support arm rotates upwardly and outwardly as it is advanced from one setting to the next higher setting. The invention may also be embodied in a system in which such downward angling of the axis of such mounting portion is eliminated whereby the support arm does not move outwardly as it moves upwardly and the automatic abduction feature is eliminated.

As is clear from FIG. 9 and accompanying description in aforementioned Ser. No. 08/412,148, in such system which uses a ratcheting table clamp, the housing around the ratchet wheel has two generally radially extending bores, one receiving the support arm and the other receiving the lock pin, whereas in the specific embodiment illustrated in the embodiment of FIGS. 1–11 of this present disclosure, the housing 26 around the ratchet wheel has a single generally radially extending bore or cavity 34. Thus in a system using a ratcheting table clamp, the support arm and lock pin may each be received in its own one of two generally radially extending bores, whereas in the embodiment of FIGS. 1–11 of this present disclosure, the support arm and lock pin may both be received in one and the same radially extending bore.

In both such embodiments, it will be understood that settings corresponding for example to ratcheting serrations 50 at the lower seven of the ten angular positions shown in FIG. 5 and to the locking serrations at the upper three of such ten angular positions represent a range of increasingly advanced fixed positions including a lower subrange corresponding to the ratcheting serrations and an upper subrange corresponding to the locking serrations.

While all ratchet wheels described above are generally disc shaped, portions of the wheel perimeter other than where the ratchet wheel serrations are formed can be cut away or the wheel otherwise modified in ways that make it more resemble an arcuate rack rather than a wheel but that do not unduly compromise its structural integrity or its operational functions. Such modifications should be understood as addressed by references herein to ratchet wheels.

Although particular embodiments of the adjustable limb support system have been illustrated and described in detail, it will be understood that the invention is not limited correspondingly in scope, but includes all changes and modifications coming within the spirit and terms of the claims appended hereto.

What is claimed is:

1. An adjustable limb support system for an operating room table, said support system comprising:

a limb support;

an adjustable support for orienting said limb support; and a vertically adjustable support for positioning said limb support and said adjustable support at one of a range of increasingly advanced fixed positions including a lower subrange of at least two relatively less advanced positions and an upper subrange of at least two relatively more advanced positions, said vertically adjustable support having a proximate end and a distal end and comprising a support arm secured to said adjustable support and extending intermediate said proximate and distal ends, an attachment for securing said vertically adjustable support to the operating room table in the vicinity of said distal end, and a ratchet wheel mechanism to allow said support arm to be rotated upwardly to said at least two positions, said ratchet wheel mechanism including a ratchet wheel having a central axis, a housing rotatable about said central axis of said ratchet wheel and having generally radially extending bore means comprising one or two bores, a lock pin associated with said ratchet wheel, said support arm being removably secured in said one bore or its own one of said two bores, a lock pin carried within said one bore or the other one of said two bores, said lock pin engaging said ratchet wheel, said ratchet wheel being shaped such that such engagement (1) allows rotation of said housing and support arm up to or past but not down from lower angular positions thereof associated with said lower subrange and (2) prevents rotation of said housing and support arm either up or down from higher angular positions thereof associated with said upper subrange, a ratchet release for disengaging said lock pin from said ratchet wheel to allow downward rotation of said housing and support arm from any fixed angular position to a lower one and to allow upward rotation of said housing and support arm from at least one of said higher fixed angular positions to a still higher one, and an attachment fixed to said ratchet wheel for securing said vertically adjustable support to the operating room table.

2. The adjustable limb support system according to claim 1 in which said ratchet wheel includes both ratcheting serrations and locking serrations, said serrations coacting with said lock pin such that such ratcheting serrations allow rotation of the support arm in only one direction and said locking serrations do not allow rotation of said support arm in either direction unless said lock pin is disengaged from said ratchet wheel by said ratchet release.

3. The adjustable limb support system according to claim 2 in which said lock pin is carried within the same bore in which said support arm is removably secured.

4. The adjustable limb support system according to claim 2 in which said lock pin is carried in one bore and said support arm is removably secured in another bore.

5. The adjustable limb support system according to claim 2 in which said support arm has an axis of rotation relative to horizontal for automatic abduction.

6. The adjustable limb support system according to claim 2 in which said support arm has a horizontal axis of rotation.

7. The adjustable support system according to claim 2 in which said attachment fixed to said ratchet wheel has a clamping portion which is adapted to receive a side rail of the operating room table.

8. The adjustable support system according to claim 2 in which said attachment fixed to said ratchet wheel is a post adapted to be received and clamped in a socket secured to the operating room table.

9. A vertically adjustable support for operably connecting a limb support to an operating room table having a side, said vertically adjustable support comprising:

a housing;

a support arm secured at one end to the housing;

a ratchet wheel having a plurality of serrations and secured within said housing for rotation of said support arm about said ratchet wheel, said serrations of said ratchet wheel including both a succession of at least three ratcheting serrations and a succession of at least two locking serrations;

a lock pin adapted to engage said ratchet wheel with said ratchet wheel serrations coacting with said locking pin such that said ratcheting serrations allow rotation of the support arm in only one direction and such locking serrations do not allow rotation of said support arm in either direction unless said lock pin is disengaged from said ratchet wheel;

a ratchet release for effecting such disengagement; and an attachment for securing said vertically adjustable support to the operating room table.

10. A vertically adjustable support in accordance with claim 9, wherein said ratchet wheel has a succession of at least 6 ratcheting serrations.

11. A vertically adjustable support in accordance with claim 10, wherein said locking serrations include substantially radial parallel side edges.

12. A vertically adjustable support in accordance with claim 10, wherein said locking serrations include one substantially radial side edge and a second side edge outwardly angled at between about 20 and 40 degrees from the radial direction.

13. A vertically adjustable support in accordance with claim 12, wherein said locking pin has a protrusion with an edge angled at substantially the same angle to the radial direction as is said second side edge, whereby said protrusion edge facially engages said second side edge of said locking serrations.

14. A vertically adjustable support in accordance with claim 9, wherein said ratchet wheel serrations extend along an angular extent of about 130 degrees.

15. A vertically adjustable support in accordance with claim 14, wherein said ratcheting serrations extend along an angular extent of about 91 degrees and said locking serrations extend along an angular extent of about 39 degrees.

16. A vertically adjustable support in accordance with claim 15, wherein said serrations are angularly spaced at intervals of about 13 degrees, whereby there are seven ratcheting serrations and three locking serrations.

* * * * *